US008459817B2

(12) United States Patent
Alberghetti et al.

(10) Patent No.: US 8,459,817 B2
(45) Date of Patent: Jun. 11, 2013

(54) FOOD REFRIGERATION APPLIANCE WITH ILLUMINATED SHELVES, AND METHOD OF PRODUCING THE ILLUMINATED SHELVES

(75) Inventors: Paolo Alberghetti, San Vendemiano (IT); Ilan Cohen, Conegliano (IT)

(73) Assignee: Electrolux Home Products Corporation N.V., Charlotte, NC (US)

( * ) Notice: Subject to any disclaimer, the term of this patent is extended or adjusted under 35 U.S.C. 154(b) by 501 days.

(21) Appl. No.: 12/670,740

(22) PCT Filed: Jul. 31, 2007

(86) PCT No.: PCT/EP2007/057925

§ 371 (c)(1),
(2), (4) Date: Jun. 21, 2010

(87) PCT Pub. No.: WO2009/015693

PCT Pub. Date: Feb. 5, 2009

(65) Prior Publication Data

US 2010/0259148 A1 Oct. 14, 2010

(51) Int. Cl.
*F21V 33/00* (2006.01)

(52) U.S. Cl.
USPC ..... 362/92; 362/133; 362/234; 62/264

(58) Field of Classification Search
USPC ..... 362/92, 94, 800, 249.02, 234, 227, 362/253, 133; 62/264
See application file for complete search history.

(56) References Cited

U.S. PATENT DOCUMENTS

| | | | | |
|---|---|---|---|---|
| 5,034,861 | A * | 7/1991 | Sklenak et al. | 362/92 |
| 2002/0051357 | A1 * | 5/2002 | Truttmann-Battig | 362/92 |
| 2006/0181885 | A1 | 8/2006 | Seng Tong | |

FOREIGN PATENT DOCUMENTS

| | | |
|---|---|---|
| DE | 202004014555 | 2/2006 |
| JP | 2005065622 | 3/2005 |
| WO | 2007136170 | 11/2007 |

OTHER PUBLICATIONS

International Search Report for PCT/EP2007/057925, dated May 13, 2008, 3 pages.

* cited by examiner

*Primary Examiner* — Bao Q Truong
(74) *Attorney, Agent, or Firm* — Pearne & Gordon LLP

(57) ABSTRACT

There is described a food refrigeration appliance (1) having a casing (2); a food refrigeration chamber (3) housed inside the casing (2); a food-supporting shelf (5) located inside the refrigeration chamber (3); and a lighting system (7), in turn having a number of spot light sources (7*a*) fixed stably to the shelf (5), and a power line (8) for electrically powering the spot light sources (7*a*); the lighting system (7) having a number of straight tracks (14) made of electrically conducting material and fixed stably to the shelf (5) to define an electric circuit (9) connecting the spot light sources (7*a*) to the power line (8).

19 Claims, 6 Drawing Sheets

FOOD REFRIGERATION APPLIANCE WITH ILLUMINATED SHELVES, AND METHOD OF PRODUCING THE ILLUMINATED SHELVES

TECHNICAL FIELD

The present invention relates to a food refrigeration appliance with illuminated shelves, and to a method of producing the illuminated shelves.

More specifically, the present invention relates to corresponding to an electric household appliance, such as a freezer or refrigerator, to which the following description refers purely by way of example.

BACKGROUND ART

As is known, home refrigerators have one or more refrigeration chambers inside for cooling or freezing food, and which are divided into compartments by a number of horizontal shelves spaced apart inside the refrigeration chamber to support the food; and a lighting system for lighting the space inside the compartments defined by the shelves, so that the food is clearly visible from outside the refrigeration chamber.

More specifically, some last-generation lighting systems comprise a number of lighting devices fixed stably to the shelves to light the space below and/or above the shelves; a main electric power line normally located outside the refrigeration chamber; and a number of electric circuits wired directly on the shelves to connect the lighting devices to the main electric power line. Shelves with lighting devices as described above are normally referred to as "illuminated" shelves.

Each lighting device normally comprises an overhead light, in turn comprising a supporting member fixed stably to the shelf, and a bulb fitted to the supporting member; and each electric circuit comprises a number of electric wires or cables connecting the bulb to the main electric line by means of an intermediate connector on the shelf.

The above lighting systems have numerous drawbacks.

First and foremost, "illuminated" shelves as described above are extremely complicated and awkward to produce, by involving fixing each overhead light to the respective shelf; connecting the electric cables electrically to both the bulb and the intermediate electric connector; and gluing the electric cables along predetermined paths on the underside of the shelf, e.g. along the outer peripheral edge of the shelf. As a result, the above manufacturing method obviously greatly increases the overall assembly time, and therefore the final production cost, of the refrigerator.

Moreover, attaching electric cables to illuminated shelves of transparent material, such as glass or Plexiglas, produces numerous shadow regions inside the refrigeration chamber compartments, which, besides reducing visibility of the foodstuffs on the shelves, creates an unsightly overall effect inside the refrigeration chamber. Being fairly thick, the electric cables, in fact, create unsightly straight grey lines on the surfaces of the shelves, which are clearly visible from the outside when the refrigeration chamber is opened.

Moreover, the electric cables form bacteria-accumulating areas on the shelves, which are difficult to clean, and, during routine cleaning, are subject to damage or accidental detachment from the surface of the shelf.

DISCLOSURE OF INVENTION

It is an object of the present invention to provide a food refrigeration appliance with illuminated shelves, which eliminates accumulation of bacteria on the shelves caused by the electric circuit, simplifies cleaning of the shelves, and eliminates the formation of shadow regions inside the refrigeration chamber.

It is a further object of the present invention to provide a highly straightforward, low-cost method of producing illuminated shelves.

According to the present invention, there is provided a food refrigeration appliance as claimed in Claim 1 and, preferably, in any one of the following Claims depending directly or indirectly on Claim 1.

According to the present invention, there is also provided a method of producing illuminated shelves for food refrigeration appliances, as claimed in Claim 12 and, preferably, in any one of the following Claims depending directly or indirectly on Claim 12.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
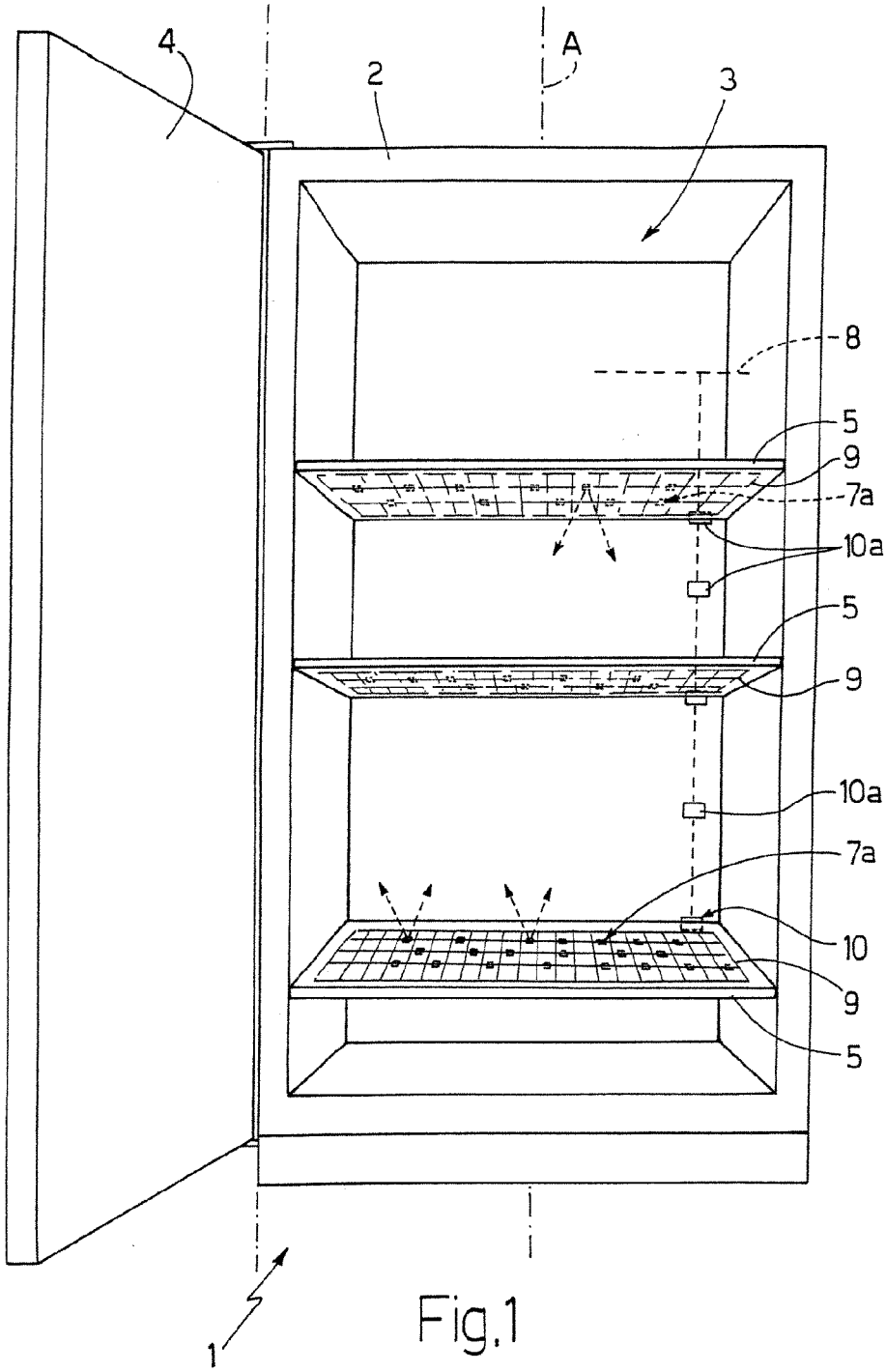
FIG. 1 shows a view in perspective of a food refrigeration appliance in accordance with the teachings of the present invention.

Number 1 in FIG. 1 indicates as a whole a food refrigeration appliance particularly advantageous for home use.

In the FIG. 1 embodiment, refrigeration appliance is a refrigerator, which substantially comprises a preferably, though not necessarily, parallelepiped-shaped casing 2 extending along a preferably, though not necessarily, vertical axis A, and resting on the floor; and at least one refrigeration chamber 3 inside casing 2 and for housing food for refrigeration.

Refrigeration appliance 1 also comprises a door 4 for closing refrigeration chamber 3, and which is hinged to a preferably, though not necessarily, lateral side of casing 2, along-side the access opening to refrigeration chamber 3, to rotate, about an axis parallel to axis A, to and from a closed position closing refrigeration chamber 3.

In the FIG. 1 example, refrigeration chamber 3 is substantially parallelepiped-shaped, and houses a number of shelves 5, each substantially horizontal to support the food for refrigeration.

More specifically, each shelf 5 is preferably, though not necessarily, rectangular, and rests on a known supporting member (not shown) inside refrigeration chamber 3.

More in detail, each shelf 5 has a first food-supporting surface and a second opposite surface and is adapted to be located inside the refrigeration chamber 3

In the FIG. 1 example, each shelf 5 is made of transparent or semitransparent, electrically insulating material, such as glass, or plastic material such as Plexiglas, and rests firmly, but in easily removable manner, on the known supporting member (not shown) inside refrigeration chamber 3.

Refrigeration appliance 1 also comprises a lighting system 7, in turn comprising a number of spot light sources 7*a* fixed stably to at least one of the two major surfaces of each shelf 5; and an external power line 8 (shown by a dash line) for electrically powering light sources 7*a*.

Lighting system 7 also comprises, for each shelf 5, an electric circuit 9 for powering light sources 7*a* on shelf 5; and an electric connecting system 10 connecting external power line 8 electrically to electric circuit 9 to power light sources 7*a*.

Electric connecting system 10 is known and not described in detail, except to state that it may comprise a number of electric connectors 10*a* located on each shelf 5 and on the inner wall of refrigeration chamber 3, and designed to connect electrically to one another, when shelf 5 is located inside refrigeration chamber 3, to connect electric circuit 9 to external power line 8.

Alternatively, electric connecting system 10 may be an induction system comprising a first and second coil (not shown) located inside shelf 5 and on the wall of refrigeration chamber 3 respectively, and wherein the second coil is connected to external power line 8 and generates a magnetic field which induces a predetermined current supply in the first coil connected to electric circuit 9 to power light sources 7*a*.

Figure 2:
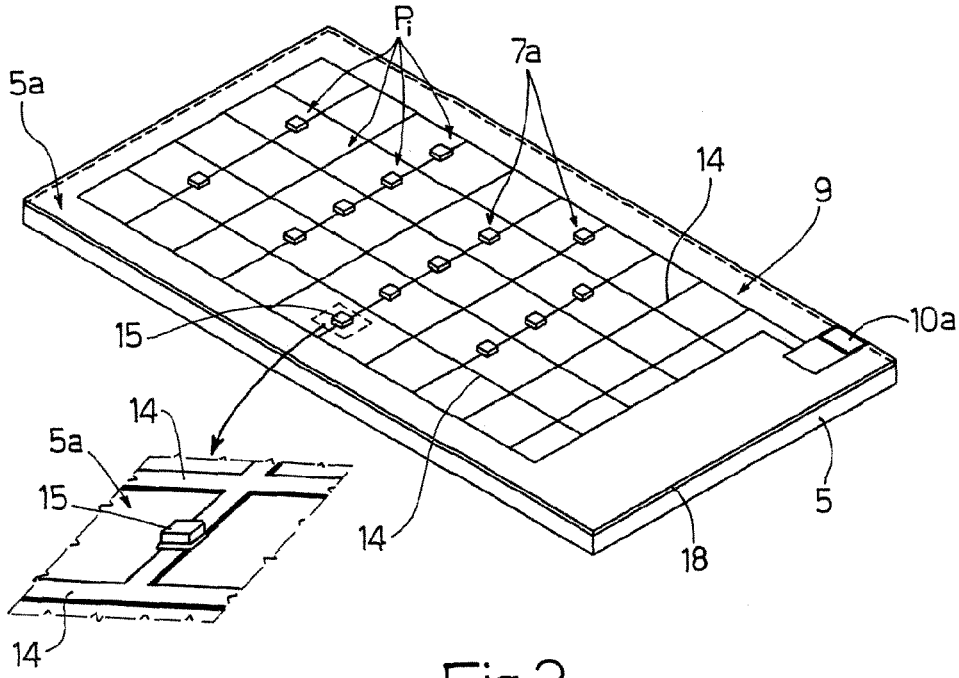
FIG. 2 shows a schematic view in perspective, with parts enlarged for clarity, of an illuminated shelf of the FIG. 1 appliance.

With reference to FIGS. 1 and 2, unlike known lighting systems, electric circuit 9 of lighting system 7, as opposed to comprising electric wires or cables, comprises, for each shelf 5, a number of tracks 14 made of electrically conducting material and appropriately arranged on an outer surface 5*a* of shelf 5 to connect electrically to light sources 7*a* on shelf 5.

More specifically, in the FIG. 2 example, tracks defining electric circuit 9 have preferably, though not necessarily a matrix-type geometric configuration, and define on shelf 5 a number of power points Pi, each connectable to a light source 7*a*.

Figure 12:
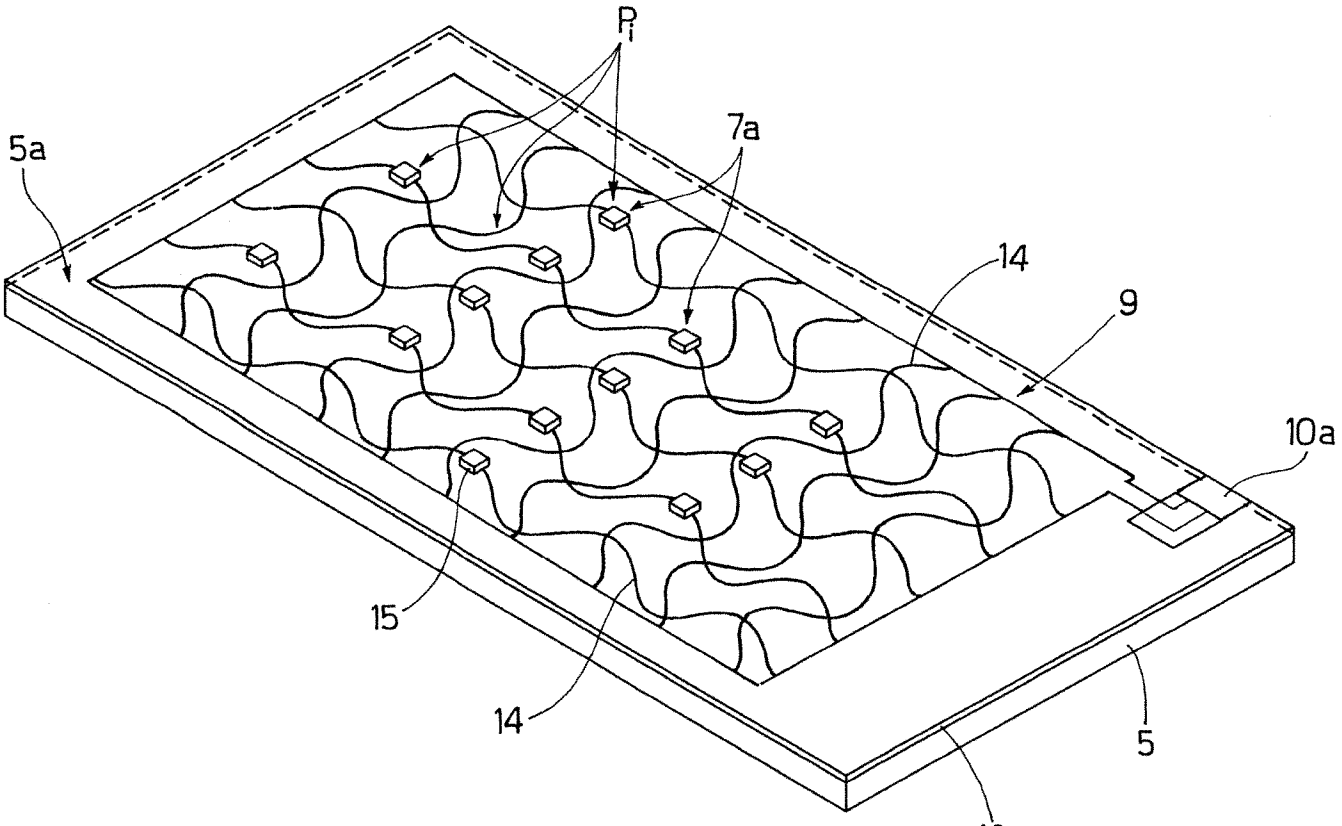
FIG. 12 shows a schematic view in perspective, with parts enlarged for clarity, of an illuminated shelf in accordance with an alternative embodiment of the present invention.

Tracks 14 extend in preferably, though not necessarily, curve (FIG. 12) or straight directions (FIG. 2) on the outer surface 5*a* of shelf 5, and may be made of at least partly conducting materials, such as electrically conducting paint, and/or electrically conducting, silver-based ink, and/or copper-based ink, and/or aluminium-based ink, and/or any other similar type of electrically conducting material that can be fixed stably to a surface.

Light sources 7*a* are conveniently spot light sources and may comprise LEDs and/or OLEDs (Organic Light Emitting Diode) and/or miniaturized incandescent light bulbs and/or miniaturized fluorescent lamps and/or any other similar type of micro-lamp.

Figure 3:
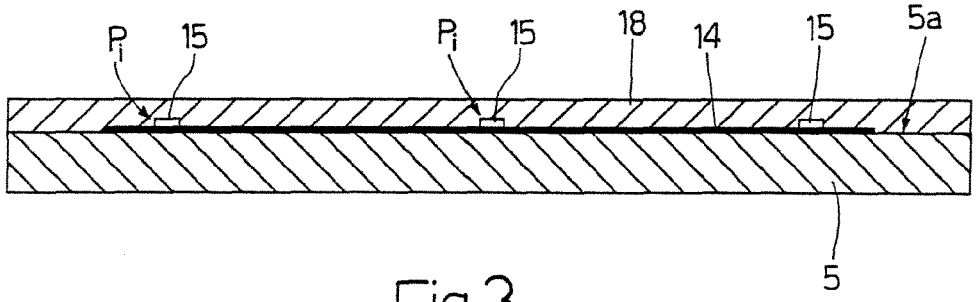
FIG. 3 shows a schematic side view, with parts removed for clarity, of an illuminated shelf of the FIG. 1 appliance.

In the FIGS. 2 and 3 example, each light sources 7*a* comprise a miniaturized, preferably SMD (Surface Mounting Device) LED 15 characterized by an extremely small thickness, i.e. of about a millimeter. It should be pointed out that, besides being smaller, miniaturized SMD LEDs 15 differ from conventional PTH (PIN Through Holes) LEDs, by being connectable electrically to the supporting surface of an electric circuit with no connecting holes required on the supporting surface.

In the FIGS. 2 and 3 example, miniaturized LEDs 15 are fixed to surface 5*a* of shelf 5 at connecting points Pi. More specifically, miniaturized LEDs 15 may be glued to the tracks 14 with electric conductive glue and/or joint with the tracks 14 by welding.

Figure 4:
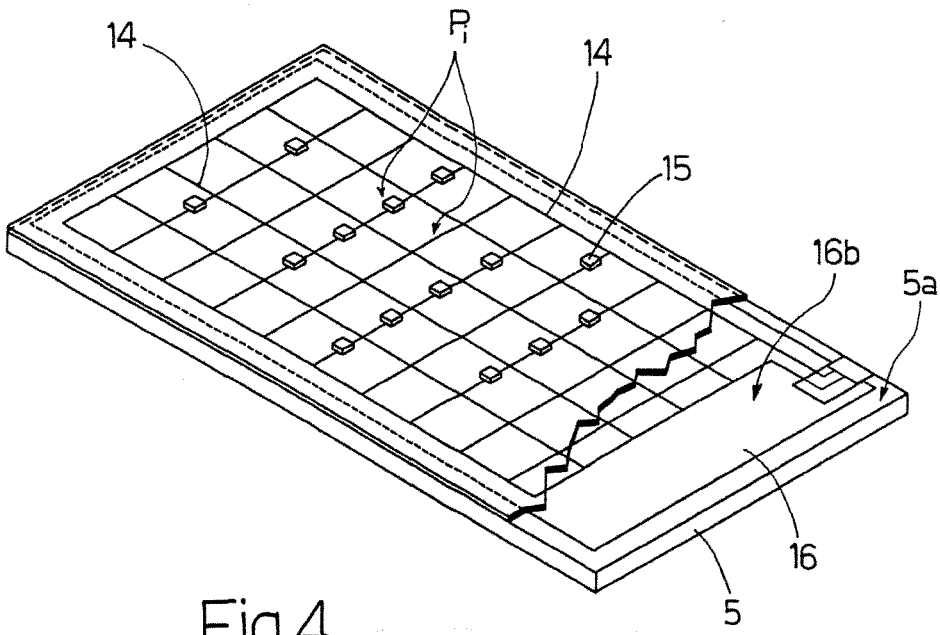
FIG. 4 shows a schematic view in perspective of a variation of the illuminated shelf of the FIG. 1 appliance.
Figure 5:
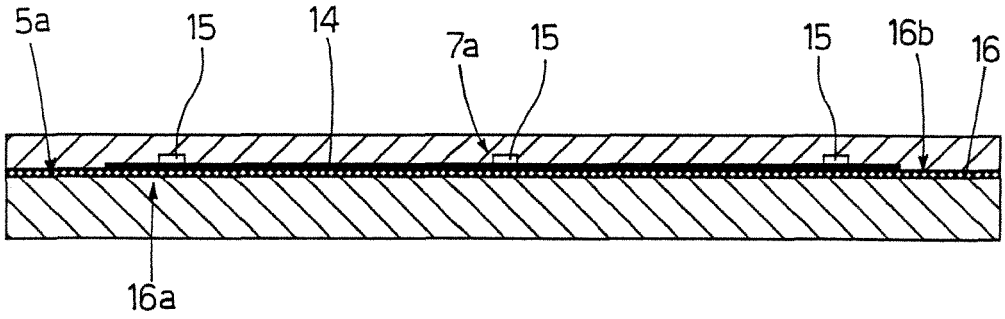
FIG. 5 shows a schematic side view, with parts removed for clarity, of the illuminated shelf in FIG. 4.

In the FIGS. 4 and 5 embodiment, tracks 14 of electric circuit 9 are fixed to outer surface 5*a* of shelf with the interposition of a supporting sheet 16 of insulating material.

More specifically, straight tracks 14 of electric circuit 9 are fixed stably to a supporting sheet 16 made of plastic material and having an adhesive surface 16*a* fixed to surface 5*a* of shelf 5.

More specifically, in the FIG. 5 example, supporting sheet 16 comprises a polyethylene film having an adhesive inner surface 16*a* fixed stably to surface 5*a* of shelf 5, and a visible surface 16*b* to which tracks 14 of electric circuit 9 are fixed stably.

It should be pointed out that, as opposed to visible surface 16*b*, tracks 14 of electric circuit 9 may be fixed to adhesive surface 16*a* of supporting sheet 16 fixed to surface 5*a* of shelf 5.

Miniaturized LEDs 15 are fixed to the surface of supporting sheet 16 to which straight tracks 14 are fixed. More specifically, in the FIG. 5 example, miniaturized LEDs 15 are fixed to visible surface 16*b* of supporting sheet 16, at connecting points Pi of tracks 14.

If tracks 14 are fixed to adhesive surface 16*a* of supporting sheet 16, however, the miniaturized LEDs may be fixed to adhesive surface 16*a*.

With reference to FIGS. 2 and 3, lighting system 7 may also comprise a protective layer 18 fixed to surface 5*a* of shelf 5 to cover tracks 14 and/or miniaturized LEDs 15.

Protective layer 18 may, for example, comprise a protective paint or a sheet of insulating material, e.g. plastic, with an adhesive surface.

The following is a description of the method of producing illuminated shelves 5 of refrigeration appliance 1 as described above.

Figure 6:
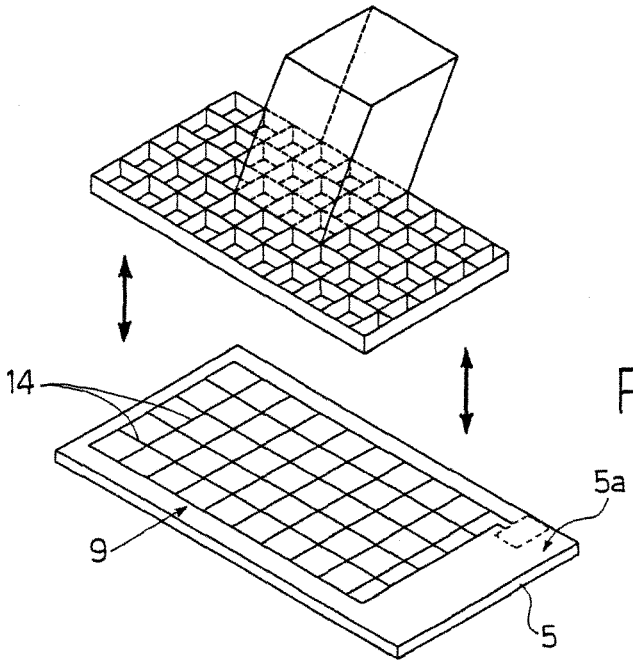
FIG. 6 shows a track fixing step forming part of the method for producing the illuminated shelf in FIGS. 2 and 3.
Figure 9:
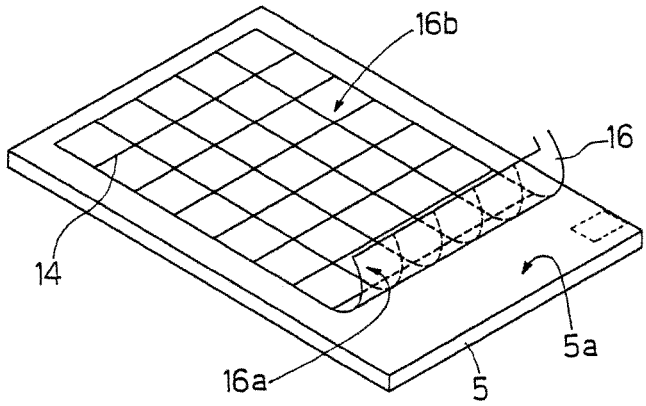
FIG. 9 shows a track fixing step forming part of the method for producing the illuminated shelf in FIGS. 4 and 5.

With reference to FIGS. 6 and 9, a first step comprises fixing tracks 14 of electrically conducting material stably to outer surface 5*a* of shelf 5, so as to form on the shelf electric connecting circuit 9 for powering light sources 7*a*.

More specifically, with reference to FIG. 6, straight tracks 14 of electrically conducting material may be fixed to outer surface 5*a* of shelf 5 by depositing and/or stamping a number of lines in electrically conducting ink or paint. More specifically, straight tracks 14 of electrically conducting material may be screen printed on outer surface 5*a* of shelf 5.

Alternatively (FIG. 9), tracks 14 may be fixed to surface 5*a* of shelf 5 by applying supporting sheet 16, to which tracks 14 are applied, to the surface of shelf 5.

It should be pointed out that tracks 14 may be fixed to surface 5*a* to define an electric connecting circuit substantially in the form of a grid or matrix.

Figure 7:
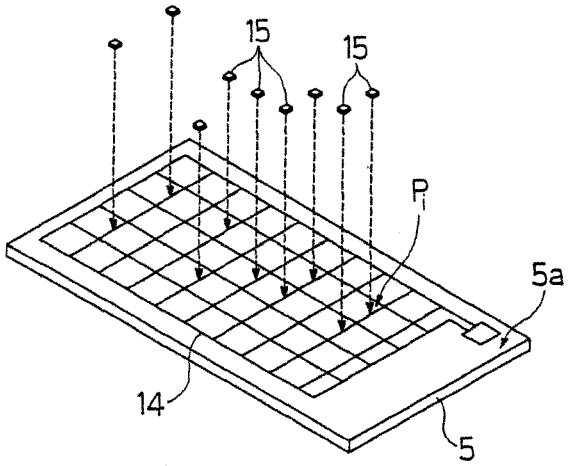
FIG. 7 shows a LED fixing step forming part of the method for producing the illuminated shelf in FIGS. 2 and 3.
Figure 10:
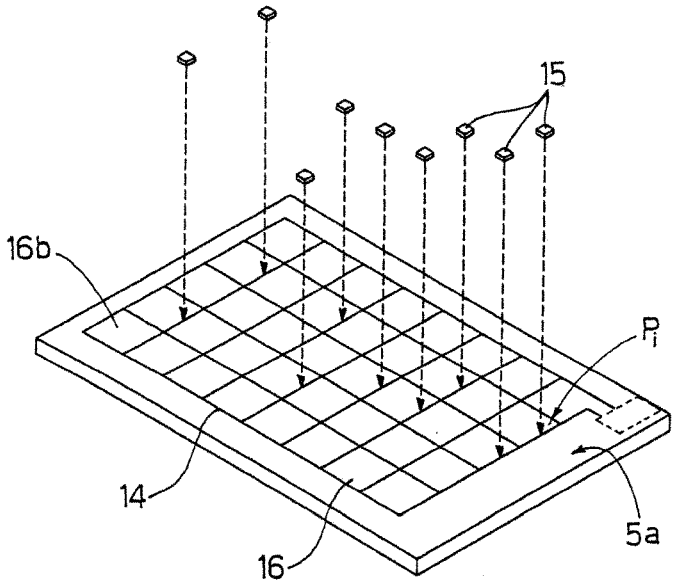
FIG. 10 shows a LED fixing step forming part of the method for producing the illuminated shelf in FIGS. 4 and 5.

Once tracks 14 are fixed to surface 5*a*, the method comprises fixing miniaturized LEDs 15 to surface 5*a* of shelf 5 (FIG. 7) or to visible surface 16*b* of supporting sheet 16 (FIG. 10) to connect them to tracks 14 at points Pi.

The method may also comprise applying a protective layer 18 of insulating material to surface 5*a* of shelf 5 to cover tracks 14.

Figure 8:
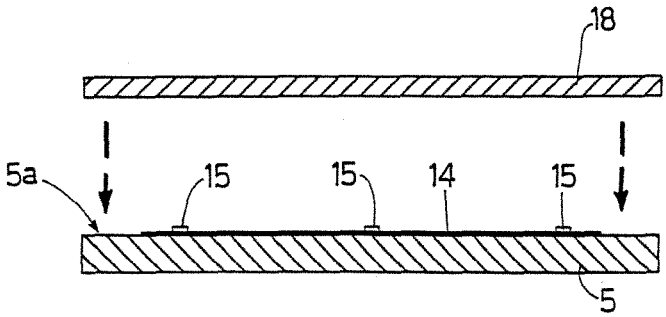
FIG. 8 shows a protective layer application step forming part of the method for producing the illuminated shelf in FIGS. 2 and 3.
Figure 11:
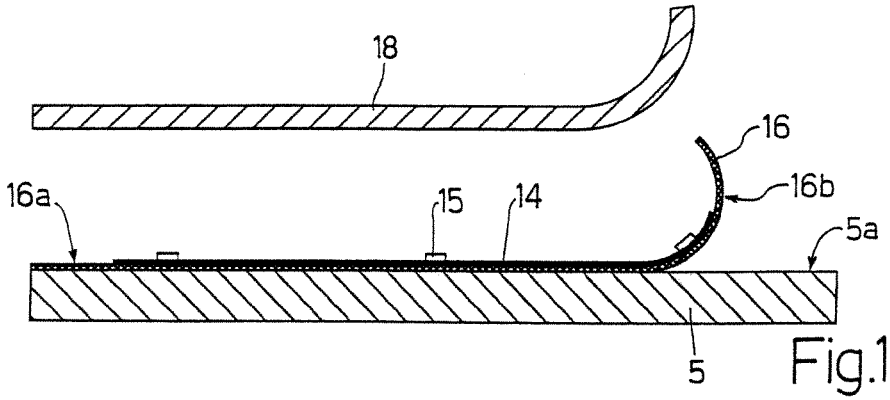
FIG. 11 shows a protective layer application step forming part of the method for producing the illuminated shelf in FIGS. 4 and 5.

More specifically, this step may comprise applying a protective layer of electrically insulating paint to surface 5*a* of shelf 5 to cover straight tracks 14 and/or miniaturized LEDs 15 (FIG. 8), or applying a film of protective insulating material on top of straight tracks 14 and/or miniaturized LEDs 15 (FIG. 11).

Refrigeration appliance 1 has numerous advantages.

First and foremost, the small thickness of the electrically conducting tracks and miniaturized lighting source, such as the miniaturized LEDs prevents bacteria accumulating in the shelf, thus making the shelf easier to clean, and, combined with the protective layer, safeguards against accidental damage to the tracks or miniaturized LEDs on the shelf.

Moreover, assembling the lighting system is extremely cheap and easy, by comprising only two straightforward operations: applying the tracks to the shelf, and applying the miniaturized LEDs to predetermined power points Pi. In the event track supporting sheet 16 is applied, the second operation may obviously be performed advantageously before applying supporting sheet 16 to shelf 5.

Clearly, changes may be made to the refrigeration appliance and to the method of producing an illuminated shelf as described and illustrated herein, without, however, departing from the scope of the present invention as defined in the accompanying Claims.

The invention claimed is:

1. A food refrigeration appliance (1) comprising a casing (2); a food refrigeration chamber (3) housed inside said casing (2); at least one shelf (5) having a first food-supporting surface and a second opposite surface and adapted to be located inside said refrigeration chamber (3); and a lighting system (7), in turn comprising a number of light sources (7*a*) fixed to said shelf (5), and power means (8, 10) for electrically powering said light sources (7*a*); said appliance being characterized in that said lighting system (7) comprises a protective layer (18) of electrically insulating material applied to at least one of said surfaces of the shelf (5) and a number of electrically conductive tracks (14) associated to at least one of said surfaces of the shelf (5) to define an electric circuit (9) connecting said light sources (7*a*) to said power means (8, 10).

2. A food refrigeration appliance (1) comprising a casing (2); a food refrigeration chamber (3) housed inside said casing (2); at least one shelf (5) having a first food-supporting surface and a second opposite surface and adapted to be located inside said refrigeration chamber (3); power means (8, 10) for electrically powering a number of light sources (7*a*) fixed to said shelf (5), and a lighting system (7), in turn comprising said light sources (7*a*) fixed to said shelf (5), a number of electrically conductive tracks (14) associated to at least one of said surfaces of the shelf (5) to define an electric circuit (9) connecting said light sources (7*a*) to said power means (8, 10), and a supporting sheet (16) of electrically insulating material, wherein the light sources (7*a*) and the electrically conductive tracks (14) are provided on said supporting sheet (16) and the supporting sheet is applied to at least one of said surfaces of the shelf (5).

3. An appliance as claimed in claim 2, wherein said electrically conductive tracks (14) are made of electrically conducting material deposited on said supporting sheet (16).

4. An appliance as claimed in claim 2, wherein said supporting sheet (16) has an adhesive surface (16*a*) adapted to be glued to at least one of said surfaces of the shelf (5).

5. An appliance as claimed in claim 2, wherein said supporting sheet (16) is made of transparent or semitransparent plastic material.

6. An appliance as claimed in claim 1, wherein said electrically conductive tracks (14) are made of electrically conducting material deposited on at least one of said surfaces of the shelf (5).

7. An appliance as claimed in claim 2, wherein said lighting system (7) comprises a protective layer (18) of electrically insulating material applied to at least one of said surfaces of the shelf (5) or to said supporting sheet (16) so as to cover the electrically conductive tracks (14).

8. An appliance as claimed in claim 7, wherein said protective layer (18) is made of transparent or semitransparent material.

9. An appliance as claimed in claim 1, wherein said shelf (5) is made of transparent or semitransparent plastic material.

10. An appliance as claimed in claim 1, wherein said light sources (7*a*) comprise light emitting diodes (15).

11. An appliance as claimed in claim 1, wherein said electrically conductive tracks (14) are made of electrically conducting paint and/or electrically conducting ink.

12. A method of producing an illuminated shelf of a food refrigeration appliance (1) comprising a casing (2); a food refrigeration chamber (3) housed inside said casing (2); and a lighting system (7), in turn comprising a number of light sources (7*a*), and power means (8, 10) for electrically powering said light sources (7*a*) ; said shelf (5) having a first food-supporting surface and a second opposite surface and being located inside said refrigeration chamber (3); and said method being characterized by comprising the step of associating a number of light sources (7*a*) and a number of electrically conductive tracks (14) to at least one of said surfaces of the said shelf (5) to define an electric circuit (9) connecting light sources (7*a*) to said power means (8, 10) and applying a protective layer (18) of electrically insulating material applied to at least one of said surfaces of the shelf (5).

13. A method of producing an illuminated shelf of a food refrigeration appliance (1) comprising a casing (2); a food refrigeration chamber (3) housed inside said casing (2); and a lighting system (7), in turn comprising a number of light sources (7*a*), and power means (8, 10) for electrically powering said light sources (7*a*) ; said shelf (5) having a first food-supporting surface and a second opposite surface and being located inside said refrigeration chamber (3); and said method being characterized by comprising the steps of:

associating a number of light sources (7*a*) and a number of electrically conductive tracks (14) to at least one of said surfaces of the said shelf (5) to define an electric circuit (9) connecting light sources (7*a*) to said power means (8, 10);

providing said light sources (7*a*) and said electrically conductive tracks (14) on a supporting sheet (16) of electrically insulating material; and applying said supporting sheet (16) to at least one of said surfaces of the shelf (5).

14. A method as claimed in claim 13, comprising the step of depositing electrically conductive material on said supporting sheet (16) so as to form said electrically conductive tracks (14).

15. A method as claimed in claim 13, comprising the step of providing said supporting sheet (16) with at least an adhesive surface (16*a*).

16. A method as claimed in claims 12, comprising the step of depositing electrically conductive material on at least one of said surface (5*a*) of said shelf (5) to form said electrically conductive tracks (14).

17. A method as claimed in claim 16, comprising the step of applying a protective sheet (18) of insulating material to at least one of said surface (5*a*) of the shelf (5) or to a supporting sheet (16) of electrically insulating material so as to cover the electrically conductive tracks (14).

18. A method as claimed in claim 16, comprising the step of applying a number of light emitting diodes (15) to at least one of said surface (5*a*) of the shelf (5) or to said supporting sheet (16).

19. A method as claimed in claim 16, comprising the step of stamping a number of lines of electrically conducting ink and/or electrically conducting paint on said surface (5*a*) of said shelf (5).

* * * * *

UNITED STATES PATENT AND TRADEMARK OFFICE

CERTIFICATE OF CORRECTION

PATENT NO. : 8,459,817 B2
APPLICATION NO. : 12/670740
DATED : June 11, 2013
INVENTOR(S) : Alberghetti et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 643 days.

Signed and Sealed this
Eighth Day of September, 2015

Michelle K. Lee

Michelle K. Lee
*Director of the United States Patent and Trademark Office*